US008430721B2

(12) United States Patent
Hsu et al.

(10) Patent No.: US 8,430,721 B2
(45) Date of Patent: Apr. 30, 2013

(54) CHEMICAL-MECHANICAL PLANARIZATION PAD

(75) Inventors: Oscar K. Hsu, Chelmsford, MA (US); Paul Lefevre, Topsfield, MA (US); Marc C. Jin, Boston, MA (US); John Erik Aldeborgh, Boxford, MA (US); David Adam Wells, Hudson, NH (US)

(73) Assignee: Innopad, Inc., Wilmington, MA (US)

( * ) Notice: Subject to any disclaimer, the term of this patent is extended or adjusted under 35 U.S.C. 154(b) by 648 days.

(21) Appl. No.: 12/347,788

(22) Filed: Dec. 31, 2008

(65) Prior Publication Data

US 2009/0170413 A1 Jul. 2, 2009

Related U.S. Application Data

(60) Provisional application No. 61/017,952, filed on Dec. 31, 2007.

(51) Int. Cl.
*B24D 11/00* (2006.01)

(52) U.S. Cl.
USPC ..... 451/56; 451/533

(58) Field of Classification Search ..... 451/41, 451/59, 56, 526–534
See application file for complete search history.

(56) References Cited

U.S. PATENT DOCUMENTS

| | | | | |
|---|---|---|---|---|
| 5,257,478 | A | 11/1993 | Hyde et al. | |
| 6,575,825 | B2 * | 6/2003 | Tolles et al. | 451/527 |
| 6,857,941 | B2 * | 2/2005 | Emami et al. | 451/41 |
| 7,264,641 | B2 | 9/2007 | Prasad | |
| 2002/0077034 | A1 * | 6/2002 | Tolles | 451/41 |
| 2005/0221723 | A1 * | 10/2005 | Duboust et al. | 451/41 |
| 2006/0188725 | A1 | 8/2006 | Yoshida et al. | |
| 2006/0276109 | A1 | 12/2006 | Roy et al. | |
| 2008/0318506 | A1 * | 12/2008 | Brown | 451/539 |

OTHER PUBLICATIONS

International Search Report and Written Opinion dated Feb. 27, 2009 issued in related International Patent Application No. PCT/US08/88672.

* cited by examiner

*Primary Examiner* — Hadi Shakeri
(74) *Attorney, Agent, or Firm* — Grossman, Tucker, Perreault & Pfleger, PLLC

(57) ABSTRACT

The present disclosure relates to a polishing pad. The polishing pad may include a polymer layer having a three-dimensional network therein and a composite layer having the ability to equalize pressure across the pad surface, including a first adhesive wherein the composite exhibits a hydrostatic modulus of 1 to 500 psi when compressed at a pressure of 1 to 50 psi.

16 Claims, 1 Drawing Sheet

CHEMICAL-MECHANICAL PLANARIZATION PAD

CROSS-REFERENCE TO RELATED APPLICATIONS

This application claims the benefit of U.S. Provisional Patent Application Ser. No. 61/017,952, filed on Dec. 31, 2007, which is fully incorporated herein by reference.

FIELD OF INVENTION

The present invention relates to a chemical-mechanical planarization (CMP) pad with an adhesive layer having dual functionality.

BACKGROUND

Conventional polishing pads for chemical-mechanical planarization (CMP) may include a composite of a first porous or filler-dispersed polymeric layer stacked with a second, soft layer. As reported in U.S. Pat. No. 5,257,478, the soft second layer has what was termed as a different hydrostatic modulus from the first layer and serving as a pressure equalizer to provide equal pressures across the semiconductor surface for uniform polish. When the second soft layer in a CMP pad is absent the uniformity of the polished wafer may deteriorate.

A third layer of adhesive may be applied to the second layer for the purpose of attaching the composite pad to the polishing tool. However, the use of a three layer structure in the conventional pad may increase the risk of separation or delamination between layers during polish. In addition, the three layer structure may entrap air bubbles or extraneous contaminants between layers resulting in difficult to detect protrusions on the pad surface, which may lead to scratching defects and non-uniformity of polish.

SUMMARY

An aspect of the present disclosure relates to a polishing pad. The polishing pad may include a polymer layer including a three-dimensional network and a composite layer having the ability to equalize pressure across the pad surface including a first adhesive wherein the composite exhibits a hydrostatic modulus of 1 to 500 psi when compressed at a pressure of 1 to 50 psi.

A further aspect relates to a method of affixing a polishing pad to a tool. The method may include adhering a polishing pad to a tool. The polishing pad may include a polymer layer, having a three-dimensional network, and a composite layer having the ability to equalize pressure across the pad surface including a first adhesive. The composite may exhibit a hydrostatic modulus of 1 to 500 psi when compressed at a pressure of 1 to 50 psi.

Another aspect of the present disclosure relates to a method of forming a polishing pad. The method may include providing a polymer layer having a three-dimensional network therein and adhering a composite layer having the ability to equalize pressure across the pad surface including a first adhesive to the polymer layer. The composite may exhibit a hydrostatic modulus of 1 to 500 psi when compressed at a pressure of 1 to 50 psi.

BRIEF DESCRIPTION OF DRAWINGS

The above-mentioned and other features of this disclosure, and the manner of attaining them, will become more apparent and better understood by reference to the following description of embodiments described herein taken in conjunction with the accompanying drawings, wherein.

DETAILED DESCRIPTION

The present invention relates to a polishing pad including a first porous or filler-dispersed polymer layer. Instead of stacking to a second soft layer, however, the first layer may be stacked directly to a composite, having the ability to equalize pressures across the semiconductor surface. The composite may include one or more adhesive layers as well as an additional layer positioned between the adhesive layers.

Figure 1:
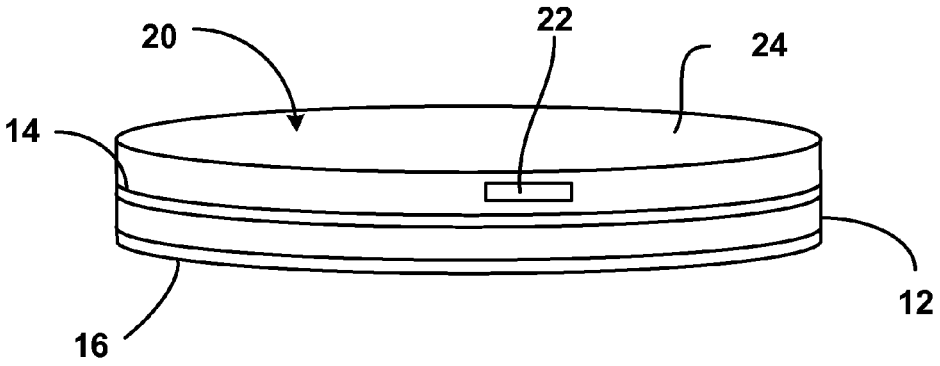
FIG. 1 illustrates an example of a CMP pad contemplated herein.

In one example, illustrated in FIG. 1, a composite that possesses pressure equalizing ability across the semiconductor surface during polish may include a sheet 12 including one or more layers 14, 16 of an adhesive coated onto the surfaces of the sheet. The composite may be adhered to the polymer layer 20. The resulting composite may exhibit an overall hydrostatic modulus from 1 to 500 psi, including all values and increments therein, when compressed under a pressure of 1 to 50 psi, including all values and increments therein. For example, the range of hydrostatic modulus may be from 150 to 250 psi, when compressed under a pressure of 1 to 10 psi, which may be broadly employed during CMP of semiconductor wafers.

The polymer layer may be formed by including a three-dimensional network 22 of soluble or insoluble materials dispersed or at least partially encapsulated in a binder 24. The polymer material may be in the form of particles, fibers and/or fabrics. The binder may include a polymer material, such as a polyurethane. The binder may exhibit a hardness $H_1$ that is greater than the hardness $H_2$ of the three-dimensional network materials.

In one example, the three-dimensional network may be placed into a mold cavity and the binder material may also be poured into the mold cavity. Heat and/or pressure may be applied to the binder and three-dimensional network mixture in the mold cavity and the polishing pad may be formed. Additional heating and/or curing steps may be employed in the formation of the pad as well. Furthermore, the pad may also be abraded to expose the three-dimensional network contained or encapsulated therein. In some examples, all or a portion of the three dimensional network may be removed from the pad providing a relatively porous three-dimensional network in the polymer layer.

Figure 2:
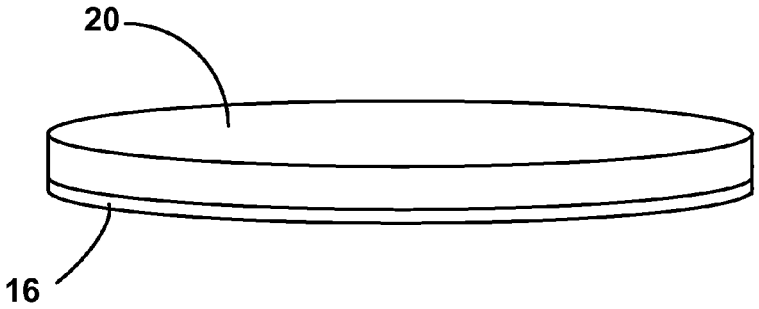
FIG. 2 illustrates an example of a CMP pad contemplated herein.

As alluded to above, the composite may include one adhesive layer. Accordingly, attention is next directed to FIG. 2, which illustrates another exemplary embodiment herein, which contains adhesive layer 16 adhered to the first porous or filled dispersed polymer layer 20. As may be appreciated, in this embodiment, the use of the sheet 12 may be avoided. However, once again, such a resulting composite may be configured to exhibit an overall hydrostatic modulus from 1 to 500 psi, through the combination of the adhesive layer 16 and polymer layer 20. Such values of hydrostatic modulus again include all values and increments between 1-500 psi, when compressed under a pressure of 1 to 50 psi.

It may be appreciated that, e.g. with reference to FIG. 1, the adhesive 14 applied to one side of the sheet may or may not be the same as the adhesive 16 applied to the opposite side of the sheet. In one embodiment, the adhesive 14 applied to one side of the sheet may exhibit a 180 degree peel strength ($PS_1$)

greater than 2.5 lbs/inch in accordance with ASTM test standard D903-98 (2004). The adhesive 16 applied to the opposite side of the sheet may exhibit a lower 180 degree peel strength ($PS_2$) of 1 to 1.5 lbs/inch in accordance with the above ASTM standard Accordingly, the peel strength of the adhesive 14 may be greater than the peel strength of the adhesive 16 and $PS_1$ may be greater (>) than $PS_2$.

In one embodiment, the adhesive applied to one side of the sheet may be acrylic based and the adhesive applied to the other side of the sheet may be sourced from a different polymer component, such as a diene type elastomer. The diene type elastomer adhesive may be cross-linked to increase its cohesive strength. Furthermore, the acrylic based adhesive side may be attached to the polishing pad while the diene type elastomer based side may be attached to the polishing tool surface. At the end of polishing, the pad may be relatively easily detached from the polishing tool due to the lower peel strength and higher cohesive strength. This may prevent adhesive residue from being left on the tool surface.

Accordingly, the adhesives may include, but are not limited to, one or more materials such as polybutadiene and polyisoprene elastomers. The polyisoprene may be natural (e.g., cis-1,4 polyisoprene) or synthetic. In addition the adhesives may include acrylic elastomers and/or polyurethane type elastomers. In addition, it is contemplated that the adhesives may include, epoxy type polymer systems and/or polyimide type systems, such as bismaleimide type adhesives. The adhesive or adhesives may be applied at a thickness in the range of 1 mil to 200 mils, including all values and increments therein, such as in the range of 1 mil to 20 mil, etc. The adhesive may be applied by various spray or coating processes, such as dip coating, screen printing, reverse roll coating, gap coating, metering rod coating, slot die coating, air knife coating, spray coating, etc.

The sheet may include, but is not limited to, one or more materials such as polypropylene, polyethylene, polyester, polyamide, polyimide, polyurethane, polysulfone, styrene and their solid and foam configurations. The sheet may also be a fabric, including woven or non-woven fabrics, or foam including a plurality of gas filled cells or pores. The thickness of the sheet may range from 0.1 to 500 mils including all values and increments therein, such as from 1 to 100 mils.

As may be appreciated from the above, the present disclosure relates to a polishing pad that may completely bypass the need for a second pressure equalizing layer as in the pads of the prior art. The composite layer containing the adhesive as disclosed herein may efficiently provide the dual function of an adhesive and a pressure equalizer. Accordingly, it may be appreciated that the pad herein may consist of a polymer layer including a three-dimensional network and a composite layer having the ability to equalize pressure across the pad surface, including a first adhesive wherein said composite exhibits a hydrostatic modulus of 1 to 500 psi when compressed at a pressure of 1 to 50 psi, with no other components necessary for such pad performance. The composite layer in the pad may also only include a sheet including a first side and a second side, a first layer of said first adhesive disposed on said first side of said sheet and a second layer of a second adhesive disposed on said second side of said sheet.

The foregoing description of several methods and embodiments has been presented for purposes of illustration. It is not intended to be exhaustive or to limit the claims to the precise steps and/or forms disclosed, and obviously many modifications and variations are possible in light of the above teaching. It is intended that the scope of the invention be defined by the claims appended hereto.

What is claimed is:

1. A polishing pad, comprising:

a polymer layer including a three-dimensional network; and a pressure equalizing composite layer consisting of a sheet including a first side a second side opposite said first side; a first adhesive layer disposed on the entirety of said first side and a second adhesive layer of a second adhesive disposed on said second side of the sheet to equalize pressure across the pad surface and to provide a hydrostatic modulus of 1 to 500 psi when compressed at a pressure of 1 to 50 psi.

2. The polishing pad of claim 1, wherein said three-dimensional network is at least partially porous.

3. The polishing pad of claim 1, wherein said adhesive layer is acrylic based.

4. The polishing pad of claim 1, wherein said polymer layer includes a binder material having a first hardness $H_1$ and said three-dimensional network exhibits a second hardness $H_2$, wherein $H_1 > H_2$.

5. The polishing pad of claim 1, wherein said first adhesive exhibits a first 180 degree peel strength $PS_1$ and said second adhesive exhibits a second 180 degree peel strength $PS_2$, wherein $PS_1 > PS_2$.

6. The polishing pad of claim 1, wherein said first adhesive is acrylic based and said second adhesive is a diene type polymer, wherein said first adhesive is affixed to said polymer layer.

7. A method of affixing a polishing pad to a tool, comprising:

providing a polishing pad comprising a polymer layer including a three-dimensional network, and a pressure equalizing composite layer consisting of a sheet including a first side a second side opposite said first side, a first adhesive layer disposed on the entirety of said first side and a second adhesive layer of a second adhesive disposed on said second side of the sheet to equalize pressure across the pad surface and to provide a hydrostatic modulus of 1 to 500 psi when compressed at a pressure of 1 to 50 psi; and adhering a polishing pad to a tool.

8. The method of claim 7, wherein said adhesive layer is acrylic based.

9. The method of claim 7, wherein said polymer layer includes a binder material having a first hardness $H_1$ and said three-dimensional network exhibits a second hardness $H_2$, wherein $H_1 > H_2$.

10. The method of claim 7, wherein said first adhesive exhibits a first 180 degree peel strength $PS_1$, and said second adhesive exhibits a second 180 degree peel strength $PS_2$, wherein $PS_{1>PS2}$.

11. The method of claim 7, wherein said first adhesive is acrylic based and said second adhesive is a diene type polymer.

12. A method of forming a polishing pad comprising:

providing a polymer layer including a three-dimensional network; and adhering a pressure equalizing composite layer consisting of a sheet including a first side a second side opposite said first side; a first adhesive layer disposed on the entirety of said first side and a second adhesive layer of a second adhesive disposed on said second side of the sheet to equalize pressure across the pad surface and to provide a hydrostatic modulus of 1 to 500 psi when compressed at a pressure of 1 to 50psi.

13. The method of claim 12, wherein said adhesive layer is acrylic based.

14. The method of claim 12, wherein said polymer layer includes a binder material having a first hardness $H_1$ and said three-dimensional network exhibits a second hardness $H_2$, wherein $H_1 > H_2$.

15. The method of claim 12, wherein said first adhesive exhibits a first 180 degree peel strength $PS_1$ and said second adhesive exhibits a second 180 degree peel strength $PS_2$, wherein $PS_1 > PS_2$.

16. The method of claim 12, wherein said first adhesive is acrylic based and said second adhesive is a diene type polymer.

* * * * *